United States Patent [19]

Lagus et al.

[11] 4,353,249

[45] Oct. 12, 1982

[54] METHOD AND APPARATUS FOR IN SITU DETERMINATION OF PERMEABILITY AND POROSITY

[75] Inventors: Peter L. Lagus, Olivehain; Edward W. Peterson, Del Mar, both of Calif.

[73] Assignee: Systems, Science and Software, San Diego, Calif.

[21] Appl. No.: 202,076

[22] Filed: Oct. 30, 1980

[51] Int. Cl.[3] ..... E21B 49/00

[52] U.S. Cl. ..... 73/155

[58] Field of Search ..... 73/155, 151, 38; 166/250, 179

[56] References Cited

U.S. PATENT DOCUMENTS

| | | | |
|---|---|---|---|
| 2,429,577 | 10/1947 | French, Jr. | 250/83 |
| 2,446,588 | 8/1948 | Herzog et al. | 250/83 |
| 2,450,265 | 9/1948 | Wolf | 250/83 |
| 2,560,510 | 7/1951 | Hinson | 250/83.6 |
| 2,747,401 | 4/1956 | Doll | 73/151 |
| 3,035,440 | 5/1962 | Reed | 73/151 |
| 3,439,740 | 4/1969 | Conover | 166/250 |
| 3,565,172 | 2/1971 | Cole et al. | 166/250 |
| 3,871,218 | 3/1975 | Louis | 73/155 |
| 3,876,003 | 4/1975 | Kisling | 166/250 |
| 4,196,619 | 4/1980 | Collins | 73/155 |

*Primary Examiner*—Jerry W. Myracle

*Attorney, Agent, or Firm*—Fitch, Even, Tabin, Flannery & Welsh

[57] ABSTRACT

A method and apparatus for in situ measurement of flow characteristics in boreholes or the like is disclosed for determining various formation characteristics such as permeability, particularly in the range of approximately 100-1,000 microdarcies and lower. One embodiment of the method and apparatus contemplates formation of a test interval in the borehole by a pair of expandable packers, additional guard zones being formed in the borehole at either end of the test interval by two additional guard packers, suitable flow conditions being simultaneously and separately measured within the test interval and each of the guard zones in order to permit determination of multidirectional components of permeability, porosity and other characteristics of the particular formation. Another embodiment contemplates whole hole testing where similar data is developed for a test interval formed between a single packer and the end of the borehole and one guard zone formed by a single additional guard packer. The method and apparatus of this invention are particularly contemplated for obtaining unambiguous measurements of multidirectional flow in low permeability formations.

41 Claims, 4 Drawing Figures

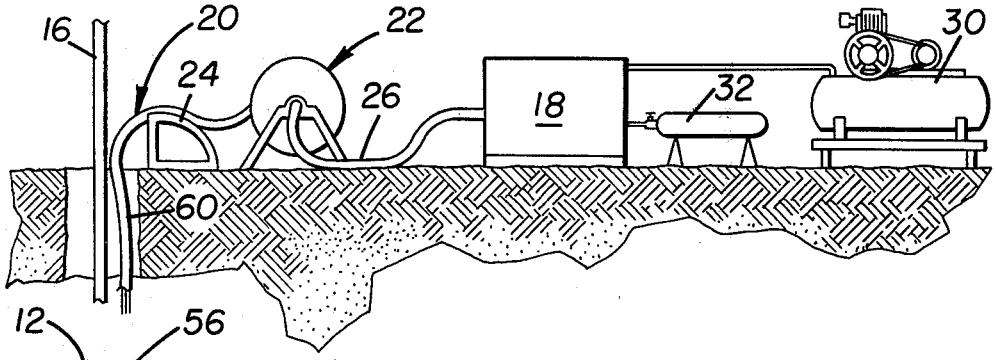
FIGURE 1
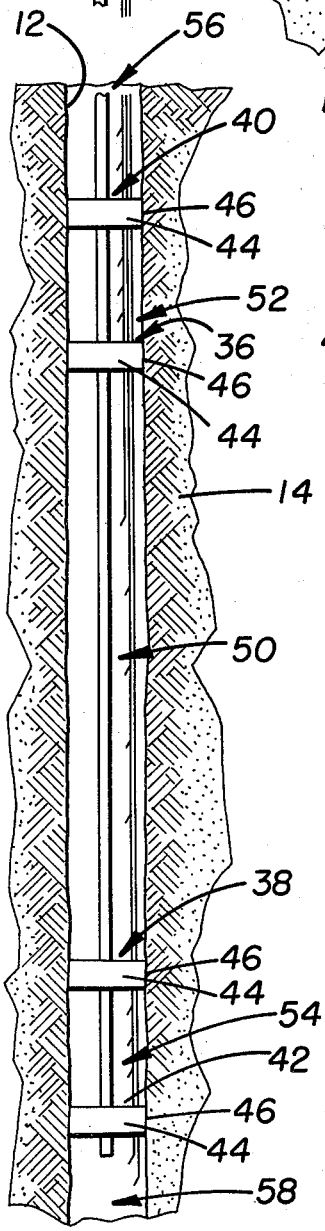
FIGURE 4
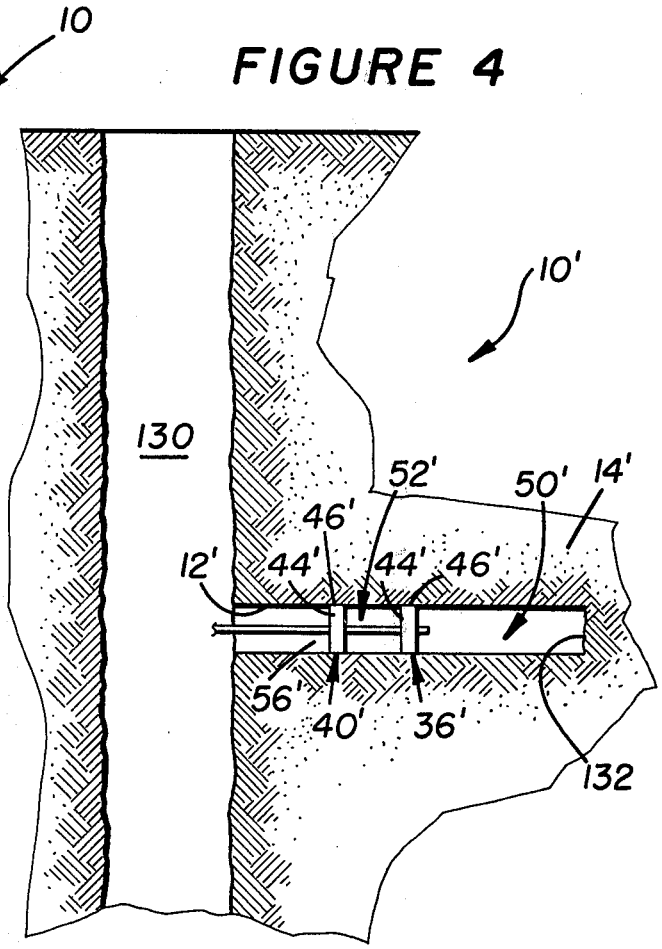

METHOD AND APPARATUS FOR IN SITU DETERMINATION OF PERMEABILITY AND POROSITY

BACKGROUND OF THE INVENTION

The present invention relates to a method and apparatus for in situ determination of permeability and other formation characteristics and more particularly to such a method and apparatus employing expandable packers for defining a test interval in a borehole.

In situ measurements of permeability in various underground formations have long been of importance. For example, such studies have been conducted in oil wells and the like as well as in mining operations, particularly those using solution mining or leaching operations. Solution mining has been employed for example in recovery of metals such as copper, uranium, lead, zinc and nickel. In connection with such mining operations, it is essential to accurately characterize the permeability of the underground formations of interest in order to determine the degree of effectiveness possible for techniques such as solution mining or leaching operations.

In addition, in situ permeability studies are of substantial importance in connection with the development of underground storage facilities for waste nuclear materials. Commonly, storage facilities are developed in extensive underground formations characterized by minimum permeability in order to assure that the materials will not leach or seep into the underground formation and escape from the immediate area of the storage facility over long periods of time.

In the prior art, substantial effort has been expended in developing techniques for characterizing permeability of such underground formations by the study of fluid flow characteristics within the underground formation. The relationship between permeability and flow characteristics has been well established, for example, under Darcy's Law or modifications thereof which define the relationship of permeability in connection with fluid flow, either liquids or gases, through a substrate under study in response to a given pressure differential or head. Additional parameters such as porosity, saturation, fluid viscosity, threshold pressures, temperature, previous testing history, fracture extent, etc. may be of importance in accurately determining such permeability values.

In essence, Darcy's Law and the like provide a means for calculating permeability in darcy units as well as other formation characteristics depending upon fluid flow characteristics measured in the substrate under question. Calculations of the type referred to above are well known in the prior art and accordingly are not set forth in greater detail herein. If desired, greater detail concerning such calculations and permeability studies in general are set forth for example in a report prepared for the Bureau of Mines, Department of the Interior, Washington, D.C., entitled, "Field Permeability Test Methods With Applications to Solution Mining," Report No. BuMines OFR 136-77, published August 1977 and further identified by Accession No. PB 272 452. That report includes a survey of existing and developing field permeability test methods conducted in order to identify methods suitable for use in feasibility investigations or performance monitoring in connection with in situ leaching of ore deposits. However, the permeability test methods disclosed in that report are equally adaptable to other applications such as those described above.

Permeability tests are commonly conducted in boreholes extending into the underground region of concern. The borehole may extend downwardly from the surface or even outwardly in any direction from underground tunnels or shafts. Flow characteristics providing means for calculation of permeability, porosity, etc. are determined by maintaining pressure within the borehole at a differential either above or below the ambient pressure of the surrounding formation. With the pressure in the borehole being below that of the surrounding formation, fluids from the surrounding formation tend to flow into the borehole. Such techniques are commonly referred to as "in-flow" tests. In such tests, the fluid flow may be either in the form of gases and/or liquids. Similarly, the borehole may also be pressurized above the ambient pressure for the surrounding formation so that fluids from the borehole tend to flow or "permeate" into the formation. Techniques of this type are commonly referred to as "outflow" tests. In tests of either the inflow or outflow type, the rate of flow of fluids into or out of the underground formation provides the basis for calculating permeability of the formation. Inflow and outflow tests of the type referred to above are also widely known in the prior art, examples being set forth for example in the Bureau of Mines report referred to above.

In conducting such tests, it is necessary to isolate a selected test interval of predetermined length at a selected location within the borehole. Such tests may be conducted at various levels in the borehole in order to completely characterize the underground formation at various depths beneath the surface. In any event, it has also become common in the prior art to employ various types of expandable packers for forming seals at various points along the borehole in order to define such isolated regions or test intervals. These packers may be of either an inflatable or a mechanical type, the inflatable packer being inflated by liquid, air or other gases in order to expand the packer into sealed engagement with the borehole. Similarly, mechanical packers are also known which are mechanically expanded through various mechanisms for similarly urging an annular seal surface of the packer into engagement with the borehole. With a pair of packers being arranged in predetermined spaced-apart relation at a given location within the borehole, an isolated region or test interval is then defined between the packers wherein permeability studies or tests of the type referred to above may be conducted. As noted above, the test interval formed between the packers may be either placed under pressure greater than the ambient pressure in the surrounding formation or evacuated to a pressure below that of the surrounding formation in order to produce either outflow or inflow test conditions as were also summarized above.

A variation of such testing procedures is commonly referred to as "whole hole testing" where a test interval is formed between a single expandable packer and the end of the shaft. Tests of this type may be used, for example, to determine formation characteristics at different locations as the borehole is being drilled or formed.

The particular construction of the packers themselves is not a feature of the present invention. Typical packer constructions may be seen for example in U.S. Pat. No.

3,876,003 issued to Kisling III on Apr. 8, 1975, U.S. Pat. No. 3,565,172 issued to Cole on Feb. 23, 1971 and U.S. Pat. No. 3,439,740 issued to Conover on Apr. 22, 1969. Each of these patents, particularly the first and last patents noted above, discloses packer assemblies of the type contemplated by the present invention.

Various techniques for carrying out flow studies resulting in the determination of permeability values for the surrounding formations are described at length in the prior art, for example, within the Bureau of Mines report referred to above. The use of such packers and the conducting of flow tests within isolated regions or test intervals provides an effective indication of permeability values for the surrounding formation. Past efforts in connection with permeability studies have tended to result only in an overall permeability value for the surrounding formation. However, underground formations are characterized by multi-directional components of permeability which may have a substantial effect on various applications contemplated for the underground formation. For example, flow between the test interval defined or isolated by the packers and the surrounding formation depends in large part upon formation permeability in radial orientation relative to the borehole. The prior art has recognized this to the extent that the test interval formed between the packers has often been extended in order to diminish "end effects" resulting from axial flow, that is, flow parallel to the length of the borehole, at opposite ends of the test interval. Such axial flow may result from permeability within the formation itself as well as from leakage around the packers due to improper sealing of the packer against the borehole walls or from axial striations extending along the borehole walls adjacent the packers. Any of these characteristics may provide an axial flow path permitting some axial fluid flow between the formation and the test interval. Furthermore, such axial fluid flow may bypass the packers so that part of the observed flow passes either from or into the borehole outside the defined test interval. Generally, such conditions, usually termed "end effects," tend to interfere with accurate characterization of permeability for the formation.

Some effort has been made in the prior art to overcome this problem and to characterize formation permeability while cancelling the effect of such axial flow, particularly that caused by packer leakage or striations in the borehole walls. For example, one such effort involved the use of two additional packers arranged in respective spaced-apart relation with the packers forming the test interval. The additional packers thus defined additional cavities at opposite ends of the test interval. According to the prior art, these two additional cavities are then placed in communication with each other, water being injected into the two additional cavities in order to maintain them at the same pressure as that observed within the test interval formed between the two primary packers. The purpose of this four-packer arrangement, with the two additional cavities, was to assure flow of fluid from the central cavity or test interval outwardly in generally radial flow into the surrounding formation. In other words, the above four-packer system was proposed and tested in order to cause flow from the test interval to be controlled by pressurization of the two additional cavities in order to satisfy an assumption of flow only in the radial direction from the central test interval. Similarly, yet another modification contemplated in the prior art was the use of three packers forming two adjacent test intervals or cavities, water being injected into one of the test cavities to provide a source, water being pumped from the other cavity in order to provide a "sink." This technique is not discussed in greater detail herein since it is believed obvious that the following discussion of shortcomings for the above four-packer system also applies to this three-packer system.

Referring again to the four-packer system described above, it was possible to further characterize lateral or radial permeability of the surrounding formation. However, tests of the type contemplated in connection with the four-packer system and in connection with all of the prior art techniques referred to above generally concerned flow rates and permeabilities of a relatively high level. For example, two, three or four-packer systems of the type provided by the prior art are generally very effective in determining permeabilities in the range above 1,000 microdarcies and, at least in some applications, even down toward a level of approximately 100 microdarcies. Measurements of this magnitude are very satisfactory for many applications such as those commonly encountered in permeability studies in connection with oil and gas field technology, in classical hydrology and the like.

However, it is becoming of greater importance to conduct permeability studies in underground formations which are considered as classically impermeable media, or which are of low permeability such as salt formations, shales, hydrites, limestone formations and the like. For example, such underground formations are commonly encountered in the formation of underground storage for nuclear waste materials and in some current applications for solution mining.

In such applications, it is commonly necessary to identify permeability values in ranges well below 1,000 microdarcies and even well below 100 microdarcies. More specifically, it may be necessary to identify permeability values in the range of 10 microdarcies and even substantially lower.

It will be immediately apparent that in a conventional borehole configuration, the determination or inference of such low level permeability values necessarily involves measurement of fluid flow at similarly reduced rates. With fluids flowing into and out of the test interval at these greatly reduced rates, any axial flow components produced either by a misfit of the packer, by striations in the borehole wall or even by axial permeability within the surrounding formation have a much greater tendency to affect and prevent accurate interpolation of radial permeability values.

Even the four-packer test system referred to above may be inadequate for accurately measuring flow characteristics necessary for precisely determining permeability values in such a situation. For example, within the four-packer system, it may be assumed that both of the packers arranged below the central test interval may have some leakage characteristics. Within the four-packer test procedure referred to above, pressurization of the additional cavity between the two leaking packers would tend to prevent detection of the leakage. At the same time, some fluid from the central test interval could flow axially past the two leaking packers to interfere with accurate characterization of flow and permeability values for the formation surrounding the central test interval.

In any event, prior art techniques such as the four-packer system referred to above have attempted to overcome the effects of multi-directional permeability by counteracting or balancing all but one directional vector. Note the reference above to enforced radial flow. However, in many applications, particularly those requiring characterization of permeability at very low darcy or microdarcy values, such treatment is not satisfactory and provision must be made for accurately and precisely characterizing the different directional components of permeability for the formation.

Thus, prior art techniques have attempted to resolve the problem of axial permeability flow or leakage flow by making measurements with a system preventing axial flow of the fluid under analysis, that is, the fluid flowing into or out of the central test interval. However, in view of the preceding remarks, it is immediately apparent that more precise knowledge of such axial permeability or flow components may be necessary in order to precisely characterize permeability values for the formation. Accordingly, there has been found to remain a need for a more precise method and apparatus for characterizing permeability in underground formations and more particularly in such formations surrounding boreholes.

SUMMARY OF THE INVENTION

It is therefore an object of the present invention to provide a method and apparatus for in situ measurement of flow characteristics of an underground formation in order to determine multi-directional components of permeability and other related characteristics of the formation. In particular, the method and apparatus of the invention are contemplated for obtaining unambiguous measurements of flow in low permeability formations. In this regard, the invention avoids ambiguities present in the prior art, for example, those arising from attempts to limit flow through the formation in a single direction.

More specifically, it is an object of the invention to provide a method and apparatus of in situ measurement of permeability in a borehole extending through the underground formation of interest by defining a test interval between spaced-apart primary packers, additional isolated guard regions being defined respectively at each end of the test interval by means of guard packers respectively spaced apart from the primary packers, a pressure differential being developed between the test interval and the surrounding formation for inducing fluid flow therebetween while simultaneously and separately monitoring selected flow conditions in the test interval and in the isolated guard regions in order to provide distinguishable indications of multi-directional permeability of the formation and possible axial leakage past the packers. Flow conditions to be monitored in the test interval and guard regions may include parameters such as actual flow volumes, temperature, pressures, tracer arrival times, tracer concentration histories, etc. These measured values may be used for determining or inferring "formation characteristics" such as permeability, porosity, fracture extent, saturation, etc.

In carrying out this object of the invention, it has been found possible to characterize permeability of underground formations at values substantially lower than those capable of measurement by prior art techniques. More specifically, prior art techniques were found to be capable of accurate determination or characterization of permeability only down to values of approximately 1,000 microdarcies and, in some instances, down to as low as 100 microdarcies. On the other hand, the method and apparatus of the present invention provide a capability for measuring flow characteristics and using that data to infer permeability, porosity and other related formation characteristics at values substantially below 100 microdarcies and more specifically, to measure and characterize permeability at values even below 10 microdarcies. In one application, the present invention had a demonstrated sensitivity which would permit determination of formation permeability at a value of 0.05 microdarcies.

The accuracy of the present invention is due at least in part to its ability to separately characterize multi-directional components of flow as well as possible axial leakage along the borehole in which the permeability tests are being conducted. The prior art, on the other hand, primarily concerns itself with characterization of composite permeability or, at best, permeability only in a radial direction from a test interval of the borehole. It will be immediately apparent that the ability to differentiate between multi-directional components of permeability is especially important in connection with low value permeabilities of the type contemplated for determination and characterization by the present invention. Similarly, whereas possible axial leakage along the borehole may be insignificant in connection with higher value permeability determination, that same amount of axial leakage or flow along the borehole has a substantial effect upon low permeability value determinations of the type contemplated by the method and apparatus of the present invention.

It is a more specific object of the invention to provide a method and apparatus of the type contemplated above wherein the test interval may be pressurized above or evacuated below the ambient pressure of the surrounding formation in order to respectively induce fluid flow outwardly from the test interval into the surrounding formation or inwardly from the surrounding formation to the test interval. Under either type of condition, selected flow conditions such as pressure, flow and temperature may be monitored in the test interval and in the respective guard regions.

It is an even more specific object of the invention to provide a method and apparatus for in situ measurement of permeability of the type described above further including means for introducing a tracer material on a high pressure side of a selected packer while monitoring the arrival time of the tracer on the low pressure side of the packer. More specifically, the method and apparatus of the present invention contemplates quantitatively monitoring the accumulation of the tracer material on the low pressure side of the selected packer. It will be apparent that the same tracer material or even different tracer materials may be introduced adjacent two or more of the packers in order to monitor axial flow conditions at different locations within the packer system.

Tracers are used to measure or detect flow which cannot be measured or detected with other state-of-the-art pressure or flow measuring devices. The use of tracer materials also permits positive identification of the source of flow into any monitored region or zone. Thus, the use of tracer materials with the present invention is particularly advantageous in low permeability formations because of the difficulty of monitoring or detecting flow with any other type of flow measuring device.

In most of the prior art concerning use of tracer materials in underground formations, effort has been directed toward mapping a reservoir, for example, where flow of the tracer material is monitored from an injection well toward one or more production wells. In the present invention, tracer materials injection and monitoring is used to assist in interpreting flow between various regions or areas of the straddle packer assembly.

It is an even more specific object of the invention to provide apparatus for conducting in situ measurements wherein the test interval and the guard regions are formed by a plurality of four packers further including an electrical cable and/or tube bundle extending down the borehole for communicating the test interval and guard regions with a surface console including pressurization and monitoring components. For example, the flow conditions may be monitored at the surface or actually measured in the packer assembly by suitable transducers with the resultant data being transmitted to the surface.

It is yet another object of the invention to provide a method and apparatus for "whole hole testing" including a primary packer for forming a test interval adjacent the end of the borehole and a guard packer for forming a separate, isolated guard region adjacent the single primary packer, flow conditions being simultaneously and separately monitored in both the test interval formed at the end of the borehole and the guard region.

Additional objects and advantages of the invention are made apparent in the following description having reference to the accompanying drawings.

BRIEF DESCRIPTION OF THE DRAWINGS

FIG. 1 is a generally schematic representation of a guarded straddle packer assembly according to the present invention, the guarded straddle packer assembly being illustrated in a borehole along with a surface console including pressurization and monitoring equipment.

FIG. 4 is a generally schematic representation, similar to that of FIG. 1, while illustrating another embodiment of a guarded straddle packer assembly according to the present invention for use in "whole hole testing."

DESCRIPTION OF THE PREFERRED EMBODIMENT

Figure 2:
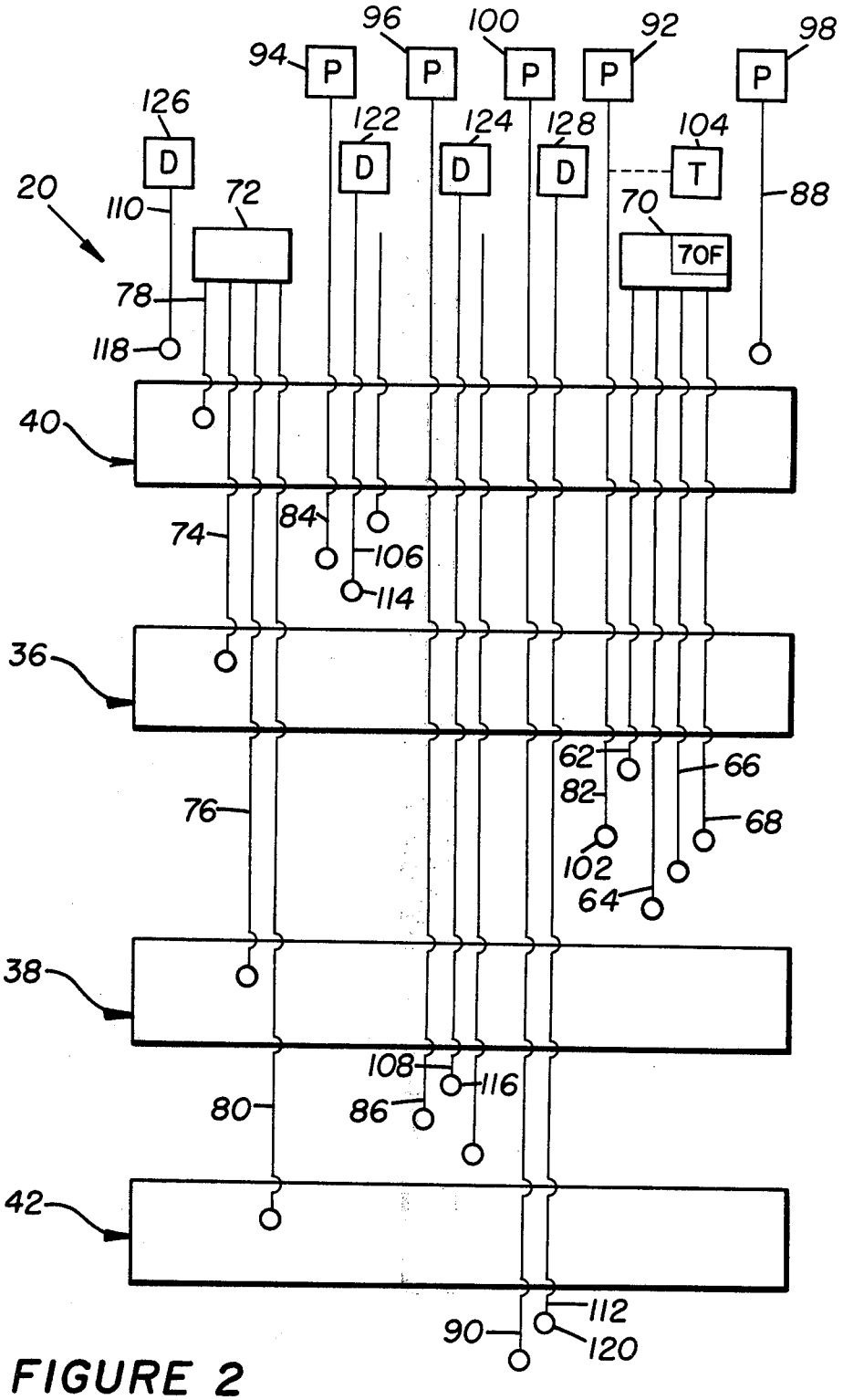
FIG. 2 is a schematic representation of pressurization and monitoring components for various zones defined in the borehole by the guarded straddle packer assembly of the invention.

Referring now to the drawings and particularly to FIG. 1, in situ permeability test apparatus suitable for performing the method of the present invention includes a guarded straddle packer assembly 10 arranged within a borehole 12 extending through an underground formation of interest, generally indicated at 14. Although the guarded straddle packer assembly 10 can be used in boreholes of any orientation such as vertical, horizontal or even slanted, the borehole 12 extends vertically downward from the surface through the underground formation 14. The guarded straddle packer assembly 10 is supported in the borehole 12 by means of a steel tubing string 16. Various zones defined within the borehole 12 in a manner described in greater detail below, are placed in communication with suitable pressurization and monitoring components in a surface console 18 by means of a tube bundle 20.

Within the above combination, the guarded straddle packer assembly 10 may be raised and lowered in the borehole by means of the tubing string 16. As the guarded straddle packer assembly is raised and lowered in the borehole, the tube bundle 20 is also raised and lowered by means of a cable winch 22 while being trained over a slide tray 24 to facilitate its passage into and out of the borehole.

An extension 26 interconnects the tube bundle on the cable winch 22 with the console 18 containing a number of pressurization and monitoring components which are described below in connection with FIG. 2. The guarded straddle packer assembly 10 of FIG. 1 is operable with various fluids, either liquid or gaseous but, in the embodiment described here, is specifically used with air. Accordingly, a conventional compressor 30 is interconnected with the control console 28 in order to provide initial pressurization in one or more zones in the borehole. An additional pressurized container 32 of a gas such as nitrogen is provided in order to permit closer regulation over fluid flow into and pressurization of the borehole in a manner described in greater detail below.

Referring now to FIG. 2 as well as FIG. 1, the guarded straddle packer assembly 10 includes four conventional expandable packers 36, 38, 40 and 42 mounted upon the tubing string 16. The spacing between the packers 36–42 may be adjusted in order to provide variation in the dimensions of the intervals or regions formed between the packers.

The packers 36–42 are of a conventional type as disclosed for example in the references noted above. Accordingly, the specific construction of the packers is not a feature of the present invention. Very generally, the packers are of an inflatable type including a rubber jacket 44 which may be expanded in a manner described in greater detail below in order to urge an annular surface 46 of the jacket into sealing engagement with the borehole.

With the packers 36–42 being arranged within the borehole 12 in the manner illustrated in FIG. 1 and expanded into sealing engagement with the borehole, they define a series of intervals or regions along the length of the borehole. Initially, the packers 36 and 38, hereinafter termed primary packers, are spaced apart to define an isolated intermediate region or test interval 50 selected along the length of the borehole 12 for permeability testing according to the invention. As noted above, the test interval 50 may be formed at any selected depth within the borehole 12 and may be of any predetermined length because of the adjustment possible for the packers upon the tubing string 16.

At the same time, additional packers 40 and 42 serve as guard packers respectively spaced apart above and below the primary packers 36 and 38. Thus, the upper primary packer 36 and upper guard packer 40 form an upper guard region 52 while the lower primary packer 38 and lower guard packer 42 form a lower guard region 54, the upper and lower guard regions being defined at opposite ends of the test interval 50. Here again, the spacing between the respective primary and guard packers may be adjusted in order to vary the length of the guard regions 52 and 54. Further in accordance with the invention, the guarded straddle packer assembly 10 forms additional end regions or zones 56 and 58 arranged respectively above and below the upper and lower guard packers 40 and 42.

Referring now particularly to FIG. 2, the tube bundle 20 consists of a plurality of approximately nineteen lengths of high pressure tubing suitable for interconnecting the console 18 with various components or areas defined by the guarded straddle packer assembly 10. The purpose for each of the high pressure tubes is described in greater detail below. In any event, the assembly of tubes is encased in one or more thick sheaths 60 intended to protect the tubes along the length of the borehole against abrasion or cutting. The sheath 60 is generally indicated in FIG. 1 while being removed from the tube bundle in FIG. 2, the tube bundle 20 being schematically expanded in FIG. 2 in order to better illustrate the manner in which it interconnects the surface console 18 with various components or areas formed by the guarded straddle packer assembly 10.

Initially, the guarded straddle packer assembly 10, as illustrated in FIG. 1, is preferably adapted for pressurization of the test interval 50 above the ambient pressure of the surrounding formation 14 to provide a so-called "injection unit" with fluid tending to flow radially outwardly from the test interval 50 into the formation 14. In accordance with the preceding comments, some fluid from the test interval 50 also tends to pass vertically or axially either through leaks formed between the packers and the borehole wall, through striations formed along the surface of the borehole or through the underground formation itself because of vertical permeability characteristics parallel with the axis of the borehole.

In order to facilitate injection type operation as described above, the tube bundle 20 includes four separate tubes 62, 64, 66 and 68 which are interconnected with the pressure sources 30 and 32 by means of a valve assembly 70. The other ends of the tubes 62, 64, 66 and 68 extend into the test interval 50. The valve assembly 70 serves to interconnect the tubes 62–68 with the pressure sources 30 and 32 in order to facilitate either initial filling or pressurization of the test interval 50 or to maintain the test interval at a predetermined operating pressure during permeability tests. As will also be described in greater detail below, the valve assembly also includes means (not otherwise illustrated) for introducing tracer materials such as gases, liquids, soluble materials, or the like, into the test interval 50.

An additional valve assembly 72 is interconnected with either or both of the pressure sources 30 and 32 while being interconnected with the packers 36, 38, 40 and 42 by means of tubes 74, 76, 78 and 80. These four tubes serve both to communicate pressurized gas for inflating the packers while also permitting monitoring of pressures developed within the packers. The valve assembly 72 includes means for separately pressurizing the packers and for individually monitoring pressure within each of the packers since one or more of the packers could be a source of leakage within the packer assembly. The valve assembly 72 is thus also better adapted for maintaining an optimum seal between each packer and the borehole. Otherwise, the packers and their method of pressurization is generally conventional in accordance with the prior art.

The tube bundle 20 also includes five tubes 82, 84, 86, 88 and 90 which are respectively in communication with the test interval 50, the upper and lower guard regions 52 and 54 and the end regions 56 and 58. These five tubes are also in communication with pressure sensors respectively indicated at 92, 94, 96, 98 and 100 contained within the console 18 of FIG. 1. The five pressure sensors are selected for very precisely and accurately monitoring pressures within the respective areas defined by the guarded straddle packer assembly 10 in order to permit precise determination of permeability values in accordance with the present invention.

The tube 82 also includes a thermistor type sensor 102 arranged in the test interval 50 while also providing for interconnection of the thermistor 102 with a temperature monitor or indicator 104 also forming a part of the surface console 18. It would also be possible to provide for temperature measurement within other areas defined by the guarded straddle packer assembly 10 such as in the guard regions 52 and 54 or even in the end regions 57 and 58. It is assumed here that temperature will be generally equal in the various areas defined by the guarded straddle packer assembly 10. However, if the packers of the packer assembly are to be widely spaced apart from each other, additional temperature sensors may be desirable or necessary in order to accurately monitor flow conditions within the borehole.

Finally, four additional tubes 106, 108, 110 and 112 extend downwardly for interconnection with tracer detector units 114, 116, 118 and 120. These detector units are respectively arranged in the upper and lower guard regions 52 and 54 and the end regions 56 and 58. The respective tubes interconnect these tracer detector units respectively with monitor or indicating detector units 122, 124, 126 and 128 which are also part of the surface console 18 of FIG. 1.

Referring again to FIG. 2, the pressurization tubes 62–68 provide a source of tracer material for the test interval 50 which, in accordance with the disclosed method of operation for the present invention, is on the high pressure side of each of the packers 36–42. The tracer gas detector units 114–120 are respectively arranged on the low pressure side of the packers. Thus, during injection tests within the borehole, vertical flow of fluid from the test interval 50 can also be monitored by the tracer detector units. Furthermore, the detector units 114–120 in combination with the monitor or recording devices 122–128 are equipped to detect initial presence of the tracer material as well as to record increasing concentration of the tracer material. Here again, tracer detector units are also gnerally conventional in accordance with the prior art and may include scintillation counters for detecting both initial presence and continuing concentration of the tracer material.

Within the disclosed embodiment of FIGS. 1 and 2, a single source of tracer material is provided within the test interval. However, it would also be possible in accordance with the present invention to provide sources of different tracer materials for example on the high pressure side of each of the packers. For example, one conventional tracer material commonly used in such application is sulfur hexafluoride gas. As illustrated in FIG. 2, each of the detector units 114–120 is adapted to monitor that particular tracer material. However, a number of other conventional tracer materials could also be employed if it were desired to use combinations of different tracer materials.

Thus, the console 18 includes means for controlling pressurization within the test interval 50 while also monitoring pressure, flow volume, temperature and the presence of tracer material within the various areas formed by the guarded straddle packer assembly 10. The surface console 18 could also of course include conventional strip chart recorders or the like (not shown) for automatically recording data obtained during permeability tests in accordance with the present invention. The other tubes which are shown but not otherwise described may be used in connection with additional monitoring or pressurization equipment as desired.

It is believed that the method of operation for the present invention will be apparent from the preceding description. However, the method of operation is described below in order to assure a complete understanding of the invention.

Initially, the packers are placed upon the tubing string 16 and lowered into the borehole 12 until they are adjacent a portion of the underground formation 14 wherein permeability testing is to be conducted. The packers are then expanded into sealed engagement with the borehole wall in the manner described above in order to define the test interval 50 and the upper and lower guard regions 52 and 54 in isolation from each other as well as from the end regions 56 and 58.

In operation, a pressure differential is developed within the test interval 50 for example by introduction or injection of pressurized gas through the tubes 62–68. In the disclosed embodiment, the test interval 50 is pressurized above the ambient pressure of the surrounding formation 14 and the guard regions 52 and 54. The guard regions 52 and 54 would normally be at approximately the same pressure as the end regions 56 and 58. However, it is also possible in accordance with the present invention to provide additional means for pressurizing one or more of these regions if necessary or desired in order to further facilitate monitoring of flow conditions within the borehole.

Initial pressurization of the test interval 50 may be performed by means of the high rate compressor 30 until the pedetermined level of pressurization is achieved. Thereafter, the valve assembly 70 may interconnect the closely regulated pressure source 32 with the test interval in order to more precisely establish a preselected pressure within the test interval 50. Pressurization of the test interval 50 may then be discontinued with pressure in the test interval being allowed to decay as fluid permeates into the surrounding underground formation 14.

At the same time in accordance with the preceding comments, fluid from the test interval 50 may flow parallel with the axis of the borehole or vertically upwardly and downwardly into the guard regions 52 and 54 and even into the end regions 56 and 58. Pressure decay within the test interval 50 is monitored by the indicator 92 while the temperature in the test interval 50 is monitored by the indicator 104. At the same time, pressure changes within the guard regions and the end regions are monitored by the pressure indicators 94–100. Similarly, the initial presence and concentration of tracer gases appearing in the guard regions and the end regions are monitored by the detector units 114–120.

Thus, the present invention provides means for monitoring flow conditions within the borehole as a basis for determining multi-directional permeability and similar characteristics of the surrounding formation and also for providing an indication of leakage about one or more of the packers. For example, rising pressures at different rates within the guard regions 52 and 54 tend to indicate leakage about one of the primary packers 36 or 38, assuming constant characteristics for the underground formation 14 and uniform surface characteristics for the borehole in those regions. At the same time, initial arrival of tracer material in the guard regions or in the end regions provides an indication of fluid flow rates and accordingly the probable flow path from the test interval 50 into those areas. For example, arrival of tracer material in either of the test intervals in a very short time would tend to indicate either leakage about the respective packer or vertical flow for example through striations in the surface of the borehole. A longer delay before arrival of tracer material in the respective guard regions would similarly tend to indicate passage of the fluid through a more tenuous portion of the underground formation. Thus, the more delayed arrival of tracer material would indicate that vertical flow is traveling through vertical permeability within the formation 14. In this manner, data developed in accordance with the present invention may be employed to more accurately infer multi-directional components of permeability and other characteristics for the formation 14.

It will also be apparent that the method of the present invention could be performed in a number of different techniques while achieving valid interpretation or determination of multi-directional permeability and other formation characteristics as described above. For example, it would also be possible to evacuate the test interval 50 for example by means of the valve assembly 70 with fluid flow then tending to pass inwardly toward the test interval 50 from the surrounding formation 14. At the same time, since the guard regions and end regions would tend to be at a higher pressure than the test interval 50, vertical flow would tend to pass toward the test interval 50. Testing of this type conforms with conventional "in-flow" test procedures as referred to above.

Furthermore, it would also be possible for example to maintain steady state pressurization within the test interval 50 for example by means of the closely regulated pressure source 32 while employing flow monitoring means 70F in the valve assembly 70 to monitor flow rate or volume of fluid passing into the test interval 50 for maintaining the predetermined constant pressure. With such a combination, the flow rate would provide an indication of passage of fluid from the test interval 50 upwardly into the underground formation 14. Otherwise, pressure variation and tracer arrival and concentration within the guard regions and the end regions would similarly serve to assist in determining multi-directional permeability components for the formation 14.

Figure 3:
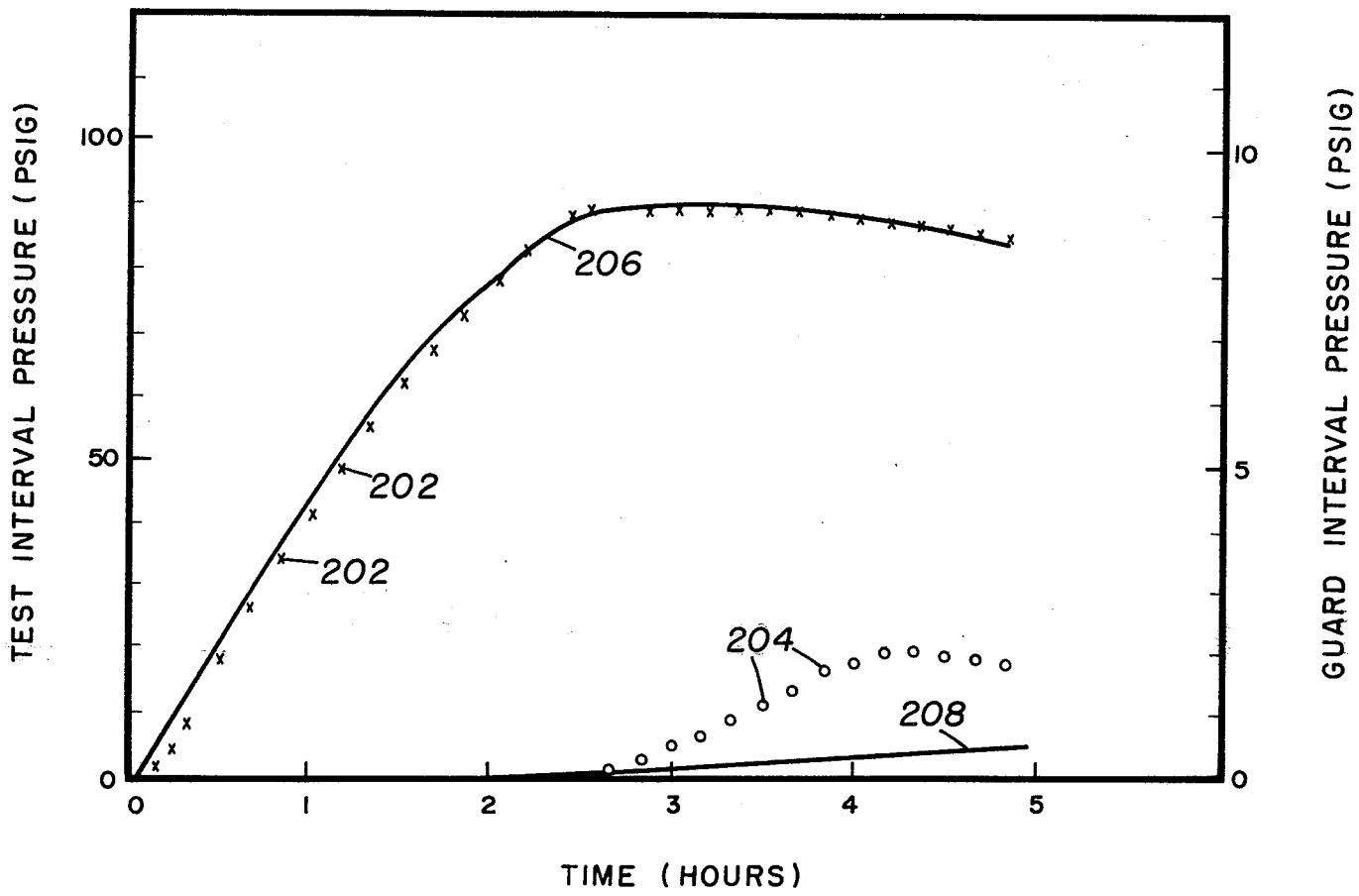
FIG. 3 is a graphical representation of an exemplary borehole test conducted with the method and apparatus of the invention.

An example of actual field test data developed by the method and apparatus of the present invention is illustrated in FIG. 3 as providing a basis for determination or inference of associated multi-dimensional formation characteristics. Referring also to FIG. 1, the data graphically illustrated in FIG. 3 was developed by an injection type test performed within the borehole 12 of FIG. 1. During injection testing, the test interval 50 was pressurized, incremental pressures throughout the injection test period being indicated at 202. During the injection test, volumetric fluid flow into the test interval 50 was also measured but is not represented in FIG. 3.

Pressures were also separately monitored and recorded for the two guard intervals 52 and 54. Since no pressure change was observed within the lower guard interval 54, no record of pressure for that interval is included in FIG. 3. However, incremental pressure values within the upper guard interval 52 are indicated at 204. It may be seen from FIG. 3 that the pressure rise within the upper guard interval 52 occurred when the test interval pressure reached about 83 psig. The guard interval pressure rise stopped when the test interval pressure dropped below this value, thereby suggesting this flow was packer bypass flow.

By trial and error including use of the flow rates observed within the test interval 50, it was then determined that the pressure changes observed within the test interval were consistent with values assuming a uniform, homogeneous, unsaturated formation having a permeability of 15 microdarcies and porosity of 0.001. In this regard, it may be seen that the values calculated for the test interval 50 would in effect be a composite value for the overall formation including both radial or horizontal flow as well as any vertical or axial flow component or leakage along the borehole.

With the composite values for the formation characteristics being established, attention may then be directed toward determination of vertical or axial components for those same characteristics. Initially, a theoretical curve of pressure for either of the guard intervals was calculated as indicated at 208 again assuming a homogenous, isotropic, unsaturated formation with the above permeability and porosity values. Since no pressure change was observed within the lower guard interval 54, it was assumed that the formation 14 is non-homogeneous to the extent that it does not include a measurable vertical or axial permeability component. Furthermore, analysis indicated that the pressure increase within the upper guard interval 52 as indicated at 204 in FIG. 3 represented leakage past the upper primary packer 36. Accordingly, through the data available in FIG. 3, actual axial flow from the test interval 50 into the guard interval 52 was calculated.

The particular example set forth in FIG. 3 and described above is relatively simple and straightforward in that there was no vertical or axial component of permeability or porosity. At the same time, the injection test described above did not include use of tracer materials as may be commonly employed in such tests. Thus, it may be seen that in certain types of underground formations and with additional flow characteristics such as arrival and concentration values for tracers, a more complex analysis could result. However, the example set forth above in connection with FIG. 3 is believed to clearly demonstrate the novel and advantageous function of the method and apparatus of the present invention and to be representative of conditions commonly encountered in borehole tests.

An additional embodiment of the invention is illustrated in FIG. 4 where the borehole 12' is formed as a horizontal extension from a vertical mine shaft 130. The guarded straddle packer assembly 10 of FIG. 1 could similarly be employed within the horizontal borehole 12' of FIG. 4 or in any other orientation for the borehole either in vertical or horizontal or even slanted orientation.

However, a modification of the guarded straddle packer assembly is generally indicated at 10' in FIG. 4 to dislcose its use in otherwise conventional "whole hole testing." Whole hole testing refers to a procedure where flow characteristics are monitored at the end of the borehole as it is being formed within the underground formation 14' of FIG. 4. Note that those components in FIG. 4 which conform with components already described in the embodiment of FIG. 1 are indicated by similar primed numerals.

In FIG. 4, the modified guarded straddle packer assembly 10' includes only a single primary packer 36' and a single guard packer 40'. The test interval 50' is formed between the single primary packer 36' and the end of the borehole as indicated at 132. Note that, in keeping with usual whole hole testing procedures, permeability studies may be conducted as the horizontal borehole 12' is being formed. Thus, a series of permeability studies may be conducted when the end 132 of the borehole is at different locations within the underground formation 14'.

In any event, a guard interval 52' is formed between the primary packer 36' and the guard packer 40'. With such an arrangement, flow characteristics such as pressure, temperature and flow volume are separately and simultaneously measured within the test interval 50' and the single guard interval 52'. Flow characteristics within the test interval 50' may vary somewhat from flow characteristics within the test interval 50 of FIG. 1 since it is to be kept in mind that the end 132 of the borehole 12' will normally allow additional flow between the test interval 50' and the surrounding formation 14'. This component of flow into or out of the test interval would of course be prevented within the guarded straddle packer assembly 10 of FIG. 1 because of the primary packer assemblies 36 and 38 arranged at opposite ends of the test interval 50.

In any event, data obtained from the test interval 50' and the single guard interval 52' of FIG. 4 could be similarly employed in the manner described above in connection with FIG. 3 to determine and infer formation characteristics such as permeability and porosity, including multi-directional or multi-dimensional components for those values. It is also to be noted that other variations such as the use of tracer material could also be employed within the packer assembly 10' of FIG. 4.

Accordingly, there have been described above two embodiments of a method and apparatus for conducting in situ permeability determinations in a borehole extending through an underground formation of interest. As indicated by the orientation of the boreholes in FIGS. 1 and 4, respectively, it will be apparent that the borehole may have any orientation within the underground formation. Similarly, although the described embodiments contemplated use of a gas such as air for conducting the permeability studies, it is to be noted that the determinations could be based on flow tests employing any fluid including gases and/or liquids. Furthermore, only a simplified example of flow values and resultant formation characteristics was described above in connection with FIG. 3. In accordance with teachings of the present invention and techniques available in the prior art, it will be apparent that a wide variety of formation characteristics could be determined by use of the present invention, those formation characteristics being further characterized as to separate multi-dimensional or multi-directional components. Accordingly, the present invention is defined only by the following appended claims.

What is claimed is:

1. In a method for in situ determination of permeability in a borehole extending through an underground formation of interest, the steps comprising defining an isolated test interval along the borehole between spaced-apart primary packers, defining additional isolated guard regions respectively at opposite ends of the test interval by means of guard packers respectively spaced-apart from the primary packers, developing a pressure differential between the test interval and the surrounding formation for inducing fluid flow therebetween, and simultaneously and separately monitoring selected flow conditions in the test interval and in the separate guard regions in order to permit determination of multidimensional formation characteristics and possible leakage of fluid past the primary packers in an axial direction relative to the borehole.

2. The method of claim 1 wherein selected flow conditions are monitored within the test interval for detecting composite flow between the test interval and the surrounding formation and between the test interval and the separate guard regions, selected flow conditions also being simultaneously and separately monitored within each of the guard regions in order to detect flow between the test interval and the respective guard regions in an axial direction relative to the borehole.

3. The method of claim 2 wherein the test interval is pressurized above the ambient pressure of the surrounding formation in order to induce fluid flow from the test interval radially outwardly into the surrounding formation in relation to the borehole and axially toward the separate guard regions.

4. The method of claim 2 wherein pressure is developed within the test interval at a level lower than the ambient pressure of the surrounding formation in order to induce fluid flow from the surrounding formation into the test interval and also to induce vertical fluid flow from the separate guard regions toward the test interval.

5. The method of claim 1 wherein the pressure differential between the test interval and the surrounding formation is maintained at a substantially constant value while monitoring test interval flow and pressure.

6. The method of claim 1 wherein pressure changes resulting from flow into or out of the test interval are monitored within the test interval.

7. The method of claim 1 further comprising the step of introducing a tracer material on a high pressure side of a selected packer and monitoring arrival time of the tracer material on a low pressure side of the selected packer in order to provide an indication of axial flow between the high pressure and low pressure sides of the selected packer.

8. The method of claim 7 further comprising the step of quantitatively monitoring the rate of accumulation of the tracer material on the low pressure side of the selected packer.

9. The method of claim 1 wherein the primary packers are arranged within the borehole to define a test interval of predetermined length at a predetermined location in the borehole.

10. The method of claim 9 wherein both the length and location of the test interval are variable.

11. The method of claim 1 wherein flow conditions simultaneously and separately monitored in the test interval and in the separate isolated guard regions include one or more of the combination of fluid flow volume, pressure and temperature.

12. The method of claim 11 wherein a tracer material is introduced on the high pressure side of a selected packer, the flow conditions being monitored on the low pressure side of the selected packer including initial arrival of the tracer material on the low pressure side of the selected packer.

13. The method of claim 12 wherein the flow conditions monitored on the low pressure side of the selected packer include the rate of accumulation for the tracer material.

14. The method of claim 1 wherein the test interval is of substantially greater length than the respective guard regions in order to facilitate measurement of axial flow therebetween.

15. The method of claim 14 wherein the test interval is pressurized above the ambient pressure of the surrounding formation in order to induce fluid flow from the test interval radially outwardly into the surrounding formation and axially toward the separate guard regions.

16. A guarded straddle packer assembly for in situ determination of permeability in a borehole extending through an underground formation of interest, comprising a pair of spaced-apart primary packers defining an isolated test interval along the borehole, an additional pair of guard packers being respectively spaced apart from the primary packers in order to define additional isolated guard regions separately formed at opposite ends of the test interval, means for developing a pressure differential between the test interval and the surrounding formation for causing fluid flow therebetween, and means for simultaneously and separately monitoring selected flow conditions in the test interval and in the separate guard regions in order to permit determination of multi-directional formation characteristics and possible leakage past the primary packers in an axial direction relative to the borehole.

17. The guarded straddle packer assembly of claim 16 wherein the monitoring means includes means in communication with the test interval for detecting composite flow between the test interval and the surrounding formation and between the test interval and the separate guard regions, and further comprising means for simultaneously and separately monitoring selected flow conditions within each of the separate guard regions in order to detect axial flow between the test interval and the respective guard regions.

18. The guarded straddle packer assembly of claim 17 wherein the pressure differential means includes means for pressurizing the test interval above the ambient pressure of the surrounding formation in order to induce fluid flow from the test interval outwardly into the surrounding formation and axially toward the separate guard regions.

19. The guarded straddle packer assembly of claim 17 wherein the pressure differential means includes means for developing a pressure within the test interval lower than the ambient pressure of the surrounding formation in order to induce fluid flow from the surrounding formation into the test interval while also inducing axial fluid flow from the separate guard regions toward the test interval.

20. The guarded straddle packer assembly of claim 16 wherein the pressure differential means includes means for monitoring flow and pressure in the test interval.

21. The guarded straddle packer assembly of claim 16 wherein the pressure differential means includes means for monitoring pressure within the test interval.

22. The guarded straddle packer assembly of claim 16 further comprising means for introducing a tracer material on a high pressure side of a selected packer and means for monitoring arrival time of the tracer material on a low pressure side of the selected packer in order to provide an indication of axial flow between the high pressure and low pressure sides of the selected packer.

23. The guarded straddle packer assembly of claim 22 further comprising means for monitoring both initial arrival time of the tracer material on the low pressure side of the selected packer and also for quantitatively monitoring the rate of accumulation of tracer material on the low pressure side of the selected packer.

24. The guarded straddle packer of claim 16 wherein the primary packers are arranged within the borehole to define a test interval of predetermined length at a predetermined location in the borehole.

25. The guarded straddle packer assembly of claim 24 wherein the packers are movable relative to each other for adjusting the length of the test interval.

26. The guarded straddle packer assembly of claim 16 wherein the monitoring means include means for simultaneously and separately monitoring one or more of the combination of fluid flow, pressure and temperature respectively within the test interval and in the separate guard regions.

27. The guarded straddle packer assembly of claim 26 further comprising means for introducing tracer material on the high pressure side of a selected packer, the monitoring means including means for monitoring initial arrival of the tracer material on the low pressure side of the selected packer.

28. The guarded straddle packer assembly of claim 27 further comprising monitoring means for measuring the rate of accumulation of tracer material on the low pressure side of the selected packer.

29. The guarded straddle packer assembly of claim 16 wherein the spacing between the primary packers defining the test interval is substantially greater than the spacing between the respective primary packers and guard packers defining the guard regions.

30. The guarded straddle packer assembly of claim 29 wherein the pressure differential means includes means for pressurizing the test interval at a pressure above the ambient pressure of the surrounding formation in order to induce fluid flow from the test interval radially outwardly into the surrounding formation and axially toward the separate guard regions.

31. In a method for in situ determination of formation characteristics in a borehole extending through an underground formation of interest by means of whole hole testing, the steps comprising defining an isolated test interval between the end of the borehole and a primary packer arranged in spaced-apart relation from the end of the borehole, defining an additional isolated guard region adjacent the test interval by means of a guard packer spaced-apart from the primary packer, developing a pressure differential between the test interval and the surrounding formation for inducing fluid flow therebetween, and simultaneously and separately monitoring selected flow conditions in the test interval and in the separate guard region in order to permit determination of multi-dimensional formation characteristics and possible leakage of fluid past the primary packers in an axial direction relative to the borehole.

32. The method of claim 31 wherein selected flow conditions are monitored within the test interval for detecting composite flow between the test interval and the surrounding formation and between the test interval and the separate guard region, selected flow conditions also being simultaneously and separately monitored within the guard region in order to detect flow between the test interval and the guard region in an axial direction relative to the borehole.

33. The method of claim 31 further comprising the step of introducing a tracer material on a high pressure side of a selected packer and monitoring arrival time of the tracer material on a low pressure side of the selected packer in order to provide an indication of axial flow between the high pressure and low pressure sides of the selected packer.

34. The method of claim 33 further comprising the step of quantitatively monitoring the rate of accumulation of the tracer material on the low pressure side of the selected packer.

35. The method of claim 31 wherein flow conditions simultaneously and separately monitored in the test interval and in the separate guard region include one or more of the combination of fluid flow volume, pressure and temperature.

36. The method of claim 35 wherein a tracer material is introduced on the high pressure side of a selected packer, the flow conditions being monitored on the low pressure side of the selected packer including initial arrival of the tracer material on the low pressure side of the selected packer.

37. The method of claim 36 wherein the flow conditions monitored on the low pressure side of the selected packer further include the rate of accumulation for the tracer material.

38. A guarded straddle packer assembly adapted for in situ whole hole testing and determination of permeability in a borehole extending through an underground formation of interest, comprising a primary packer being spaced apart from the end of the borehole for defining an isolated test interval therebetween, an additional guard packer being spaced apart from the primary packer in order to define an isolated guard region separately formed adjacent the test interval, means for developing a pressure differential between the test interval and the surrounding formation for causing fluid flow therebetween, and means for simultaneously and separately monitoring selected flow conditions in the test interval and in the separate guard region in order to permit determination of multi-dimensional formation characteristics and possible leakage past the primary packer in an axial direction relative to the borehole.

39. The guarded straddle packer assembly of claim 38 wherein the monitoring means includes means in communication with the test interval for detecting composite flow between the test interval and the surrounding formation and between the test interval and the separate region, and further comprising means for simultaneously and separately monitoring selected flow conditions within the separate guard region in order to detect axial flow between the test interval and the respective guard region.

40. The guarded straddle packer assembly of claim 38 further comprising means for introducing a tracer material on a high pressure side of a selected packer and means for monitoring arrival time of the tracer material on a low pressure side of the selected packer in order to provide an indication of axial flow between the high pressure and low pressure sides of the selected packer.

41. The guarded straddle packer assembly of claim 40 further comprising means for quantitatively monitoring the rate of accumulation of tracer material on the low pressure side of the selected packer.

* * * * *

UNITED STATES PATENT AND TRADEMARK OFFICE

CERTIFICATE OF CORRECTION

PATENT NO. : 4,353,249

DATED : October 12, 1982

INVENTOR(S) : Lagus and Peterson

It is certified that error appears in the above-identified patent and that said Letters Patent is hereby corrected as shown below:

Column 1, immediately after the title: Add the following paragraph:

--The United States Government has rights under this invention pursuant to SANDIA Purchase Order No. 13-4461 with Systems, Science and Software under Contract No. DE-AC04-76DP00789 between the Department of Energy and Western Electric Company.--

Signed and Sealed this

Seventeenth Day of March, 1987

*Attest:*

*Attesting Officer*

DONALD J. QUIGG

*Commissioner of Patents and Trademarks*